US006182773B1

(12) United States Patent
Borgman

(10) Patent No.: US 6,182,773 B1
(45) Date of Patent: Feb. 6, 2001

(54) BLASTHOLE DRILL HAVING A DRILL PIPE SEAL ASSEMBLY

(75) Inventor: Neil E. Borgman, Muskego, WI (US)

(73) Assignee: Harnischfeger Technologies, Inc., Wilmington, DE (US)

( * ) Notice: Under 35 U.S.C. 154(b), the term of this patent shall be extended for 0 days.

(21) Appl. No.: 09/411,734

(22) Filed: Jan. 10, 1999

(51) Int. Cl.[7] ..... E21C 7/02
(52) U.S. Cl. ..... 175/209
(58) Field of Search ..... 15/220.4, 104.4; 166/84.1; 175/84, 195, 203, 209, 213, 207, 210–211; 277/562

(56) References Cited

U.S. PATENT DOCUMENTS 2,191,817 * 2/1940 Shelor ..... 15/210
2,611,146 * 9/1952 Buckley ..... 15/210
2,916,758 * 12/1959 Hamilton ..... 15/210
3,800,890 * 4/1974 Gyongyosi et al. ..... 175/209
3,946,818 * 3/1976 Ek ..... 175/209
4,521,232 * 6/1985 Howeth ..... 55/324
4,955,436 * 9/1990 Johnston ..... 166/82
5,217,069 * 6/1993 Badon ..... 166/84
5,391,110 * 2/1995 Linberg et al. ..... 454/64

* cited by examiner

*Primary Examiner*—Robert E. Pezzuto
(74) *Attorney, Agent, or Firm*—James Earl Lowe, Jr.; David R. Price

(57) ABSTRACT

A blasthole drill includes a drill pipe seal to seal an opening around a drill pipe which extends through a drill deck in order to substantially prevent drilled ground material, such as dust and rock chips, from escaping into the atmosphere. The seal comprises a pliable membrane which is capable of sealing the opening around the drill pipe and which also allows the drill pipe to be positioned in variable drilling positions while still providing the necessary sealing arrangement. First and second flexible seal flaps are connected to the drill deck in an overlapping fashion. The seal flaps are separable to allow the drill pipe to pass therethrough, but otherwise remain overlapped. The flexible seal flaps substantially seal the opening around the drill pipe in any operable position of the drill pipe. To increase the sealing effectiveness, additional pairs of similar seal flaps may be added. The drill pipe seal allows the drill angle of the drill pipe to be changed without having to remove the drill pipe from the drill deck.

17 Claims, 4 Drawing Sheets

42

IV
178
146
142
154
78
170
174
106
62
194
38
32
VI
VI
82
190
182
74
146
142
178
IV
66

78
74
142
146
174
150
206
170
186
154
202
206
210
50
206
210
38

BLASTHOLE DRILL HAVING A DRILL PIPE SEAL ASSEMBLY

FIELD OF THE INVENTION

The present invention relates generally to blasthole drills which incorporate a sealing device or a sealing assembly to seal an opening around a drill pipe to prevent unwanted dust, debris and the like from undesirably escaping into the atmosphere.

BACKGROUND OF THE INVENTION

Blasthole drills are large earth drilling machines typically used in mining operations to drill holes for explosives. A conventional blast hole drill comprises a frame supported by crawlers for movement over the ground. A drill deck having a large rectangular opening is supported by the frame. A mast is supported by the frame for movement relative to the frame between a vertical position and a plurality of non-vertical positions. A drill pipe or drill string is supported relative to the mast, and a drill cutter bit is connected to a lower end of the drill pipe. The drill pipe extends through the opening of the drill deck and the shape of the opening allows the drill pipe to be positioned at the desired angle relative to the drill deck for drilling purposes. A rotary head engages an upper end of the drill pipe and moves along the mast. The rotary head rotates the drill pipe, and thus the drill cutter bit, into the ground.

During operation, when a drill cutter bit is caused to rotate and move downward into the ground, the drilled earthen material, such as dust, rock chips, rubble, and the like, travels up alongside the drill pipe and out of the drilled hole such that the drilled material is thereafter collected in a curtained-off area between the blasthole drill and the ground. In an effort to prevent escape of the earth cutting dust and the like into the surrounding environment, it is known to seal the opening of the drill deck and, in particular, to seal the opening around the drill pipe relative to the drill deck.

Known mechanisms designed to seal a substantial portion of the opening of a drill deck include a plurality of overlapping, typically square or rectangular, rigid metal plates which are adjustably secured to a track on the drill deck. The metal plates are positioned one above another so as to define overlapped portions between adjacent metal plates whereby the overlapped portions are generally perpendicular to the plane in which the drill pipe moves. As is generally known, the location of the metal plates with respect to each other depends on the angle of the drill pipe relative to the drill deck as the drill pipe extends through the opening of the drill deck. For example, if the drill pipe is in a vertical position, all of the metal plates are typically located to one side of the drill pipe. On the other hand, if the drill pipe is in a non-vertical position, one or more of the metal plates are typically located on one side of the drill pipe and one or more of the metal plates are typically located on an opposite side of the drill pipe. Although these metal plates are known to substantially seal the majority of the opening of the drill deck, the metal plates are not typically designed to independently seal the opening directly around the drill pipe. Thus, it is generally known to provide a dust cone and a dust cone carrier to be used in cooperation with the metal plates so as to seal the opening around the drill pipe. The dust cone carrier is typically also a metal plate which is adjustably secured to a track of the drill deck in much the same fashion as the metal plates. The dust cone carrier generally includes an elliptical hole through which the drill pipe can extend. The elliptical hole allows the drill pipe to pass through the dust cone carrier in any operable angular position relative to the drill deck. A dust cone of known material is secured to the dust cone carrier and extends below the dust cone carrier into the curtained-off area between the blasthole drill and the ground. The dust cone is generally configured such that the larger diameter hole of the dust cone is positioned near or adjacent the bottom side of the dust cone carrier, and the smaller diameter hole of the dust cone is positioned near, or in actual contact with, the drill pipe. In some known mechanisms, one or more plastic or rubber-like sheets having circular holes therethrough may be located internal to the dust cone in order to surround and possibly come into contact with the drill pipe.

In such known mechanisms, as the drilled material travels up alongside the drill pipe and out of the drilled hole, the shape and location of the dust cone is designed to prevent the drilled material from continuing on up alongside the drill pipe and also cause the drilled material to fall into the curtained-off area between the blasthole drill and the ground. The plastic or rubber-like sheets, if utilized, are intended to prevent any drilled material which happens to pass between the small diameter hole of the dust cone and the outer surface of the drill pipe from continuing farther up alongside the drill pipe. As a result, in conjunction with the metal plates, dust and the like is prevented from escaping into the atmosphere through the opening in the drill deck of a blasthole drill.

There are other known mechanisms for sealing an opening around a structure, but such mechanisms are generally not suitable for use in typical blasthole drill equipment for reasons commonly known to those skilled in the art.

SUMMARY OF THE INVENTION

Blasthole drills are frequently required to drill holes at angles other than vertical, typically, at angles up to 30 degrees or more off of vertical. As previously explained, known blasthole drills allow a drill pipe to pass through the opening of a drill deck at the desired angle. Nonetheless, problems do occur with the mentioned known sealing mechanisms when it is desired to change the drilling angle of the drill pipe relative to the drill deck.

One problem is attributable to the necessary manual handling of the metal plates to seal that portion of the opening of a drill deck not immediately surrounding the drill pipe. When the blasthole drill pipe is in a vertical position, the dust cone carrier is usually located all the way to one end of the drill deck and the metal plates are all located to the same side of the dust cone carrier in an overlapping manner as previously described. However, when the drill pipe is positioned off of vertical, its location, and thus the location of the dust cone carrier, relative to the drill deck moves. Therefore, when the drill pipe is positioned in a non-vertical position, in order to close that portion of the opening not immediately surrounding the drill pipe, some of the metal plates will be positioned to one side of the dust cone carrier and some of the metal plates will be positioned on an opposite side of the dust cone carrier. To properly position the metal plates, the metal plates are manually handled by one or more individuals, depending on the size of the metal plates, and manipulated into place with respect to the drill deck and dust cone carrier. This process has proven to be a somewhat cumbersome and time-consuming operation.

Another problem is attributable to passing the drill pipe through or removing the drill pipe from the opening of the drill deck so that the desired drilling angle can be set. Because of the manner in which the metal plates function, the drill pipe must be removed from the drill deck opening everytime a change in the drilling angle is required. As known, the drill cutter bit extends farther radially outward with respect to a drill hole axis extending through the drill pipe than the outer surface of the drill pipe so that the drilled material is able to travel up alongside the drill pipe and out of the drilled hole during operation of the blasthole drill. Thus, when the drill pipe is passed through or retracted from the opening of the drill deck, the sharp edges of the drill cutter bit are known to rip or otherwise damage the dust cone near the small diameter hole of the dust cone. Moreover, if utilized, the plastic or rubber-like sheets located internal to the dust cone may also be damaged by the drill cutter bit as a result of their close relationship with the outer surface of the drill pipe. As can be appreciated, such damage to the dust cone and/or plastic or rubber-like sheets can adversely affect the sealing of the opening around the drill pipe. Further, damage to the dust cone and/or plastic or rubber-like sheets may require frequent replacement thereof which adds unnecessary expense and downtime to the overall operation of the blasthole drill. Alternatively, it is possible for the dust cone and plastic or rubber-like sheets to be installed after or removed before the drill pipe is passed through or is retracted from the opening in the drill deck, but such operations are unduly burdensome and excessively inefficient.

Accordingly, the present invention provides a blasthole drill which alleviates these problems and many other problems known to those skilled in the art. The present invention provides a blasthole drill which allows the drilling angle of the drill pipe to be changed while the drill pipe is extending through the opening of the drill deck. The present invention also provides a blasthole drill which allows for variable positioning of the drill pipe with respect to the drill deck and which allows the drill pipe to be moved relative thereto without having to manually handle or manipulate any sealing components which are designed for sealing the opening of the drill deck and/or sealing the opening around the drill pipe. The present invention provides a blasthole drill incorporating a new apparatus to seal the opening in a drill deck, and in particular the opening around the drill pipe, in order to minimize passage of drilled material through the opening and into the atmosphere.

In particular, the present invention provides a sealing assembly which includes a pliable membrane of suitable material which is connected to the drill deck and which surrounds the drill pipe to substantially seal the opening around the drill pipe when the drill pipe extends through the opening. More particularly, the pliable membrane comprises a plurality of overlapping sheets. Even more particularly, the pliable membrane comprises flexible seal flaps which are connected to a drill deck such that a first seal flap at least partially overlaps and engages a second seal flap. The seal flaps are separable to engage opposite sides of a drill pipe when the drill pipe passes through an opening of the drill deck. The seal flaps substantially seal the opening around the drill pipe when the drill pipe extends through the opening in order to minimize passage of drilled material through the opening.

Preferably, there is provided at least one set of flexible seal flaps connected to the drill deck. Each seal flap includes a free edge. A first set of seal flaps is arranged relative to the drill deck such that one seal flap partially overlaps and lays upon another seal flap, wherein the free edges of the respective seal flaps are located on opposite sides of a plane traveled by the drill hole axis of the drill pipe upon movement of the mast. The seal flaps are separable so that the free edges of the seal flaps can engage opposite sides of the drill pipe when the drill pipe extends through the opening in order to substantially seal the opening around the drill pipe in each operable position of the drill pipe.

To increase the effectiveness of sealing the opening around the drill pipe, one or more additional sets of flexible seal flaps which are substantially similar to the first set of seal flaps can be located below the first set of seal flaps.

To further increase the effectiveness of sealing the opening around the drill pipe, at least one set of flexible end seal flaps cooperates with the other seal flaps to further surround the drill pipe when the drill pipe is near an end wall of the drill deck.

A feature of the present invention is to provide a blasthole drill which does not require the use of conventional dust cone carriers, dust cones and adjustable metal plates which inhibit drilled earthen material from passing into the atmosphere.

Another feature of the present invention is to provide a blasthole drill which incorporates an apparatus which seals the opening around a drill pipe and which is not damaged by a drill cutter bit when it is desired to change the drilling angle of the drill pipe.

A further feature of the present invention is to provide a blasthole drill which allows for the adjustment of the drilling angle of a drill pipe without having to remove the drill pipe from the opening of the drill deck when it is desired to change the drilling angle of the drill pipe.

Yet another feature of the present invention is to provide a blasthole drill which allows for adjustment of the drilling angle of a drill pipe without having to disassemble any part of the sealing apparatus designed to seal the opening around the drill pipe.

Still another feature of the present invention is to provide a blasthole drill having a sealing assembly which effectively seals the opening around a drill pipe and which is more economical to manufacture and use than what has hitherto been provided.

Other features and advantages of the invention will become apparent to those skilled in the art upon review of the following detailed description, claims and drawings in which like numerals are used to designate like features.

Figure 1:
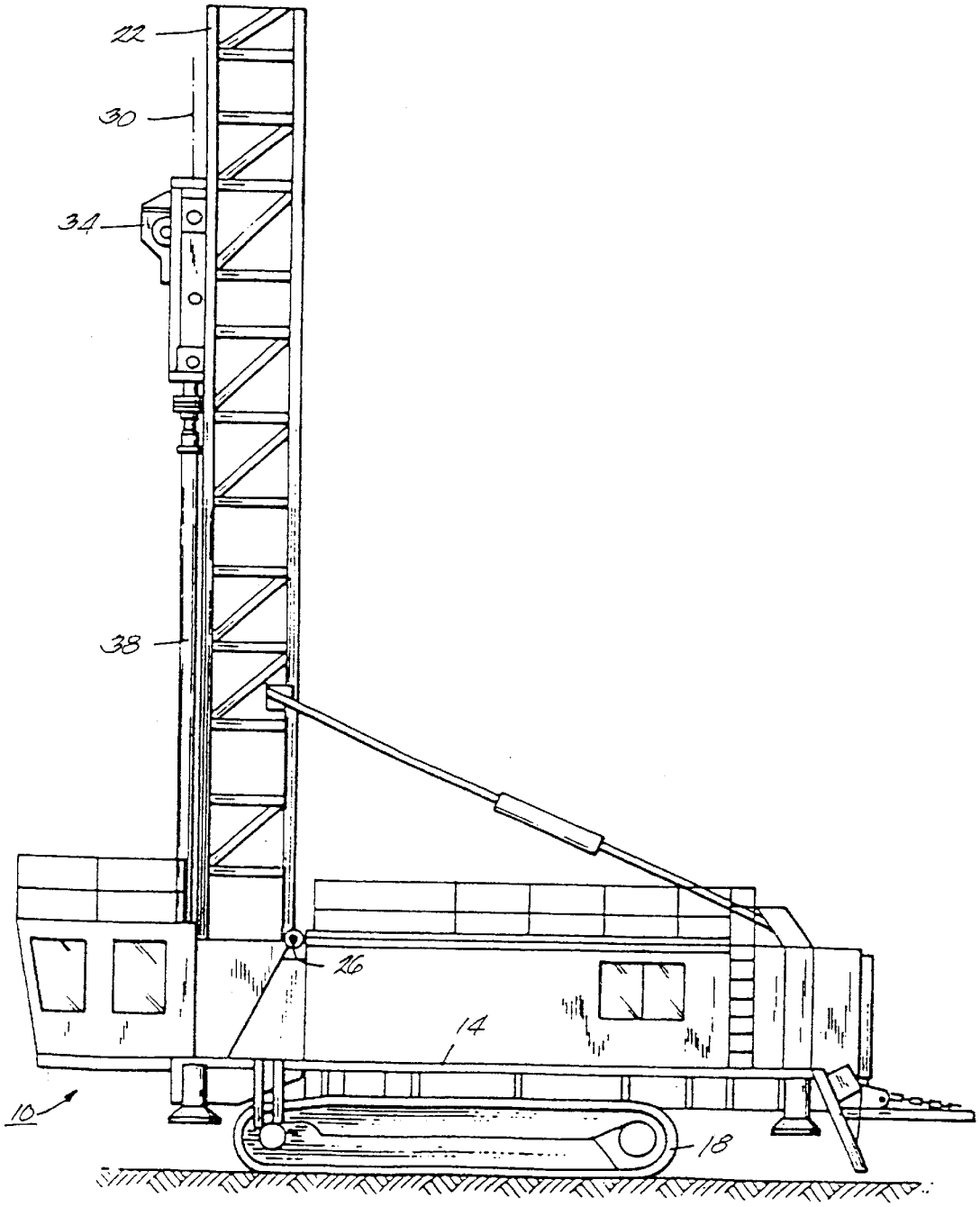
FIG. 1 is a side elevational view of a blasthole drill in which the present invention is employed.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENT

Illustrated in FIG. 1 is a blasthole drill 10 in which the present invention is employed, it being understood that a drill pipe seal according to the present invention is capable of use in other blasthole drills and in other constructions where an opening around a structure requires sealing. The blasthole 10 comprises a frame 14 supported by crawlers 18 for movement over the ground. A mast 22 is supported by the frame 14 for movement relative thereto about a generally horizontal axis 26 between a substantially vertical position (as shown) and a number of angled or non-vertical positions. The mast 22 defines a drill hole axis 30 which moves in a plane 32 (see FIGS. 4 and 5) as the mast 22 moves relative to the frame 14. A rotary head 34 is movable relative to the mast 22 along the drill hole axis 30. The rotary head 34 is selectively engageable with an upper end of a drill pipe 38 which is supported relative to the mast 22. The frame 14, crawlers 18, mast 22, rotary head 34 and drill pipe 38 can be of conventional construction and do not require a detailed description. Known blasthole drills are described, for example, in U.S. Pat. Nos. 5,622,232 and 5,653,297 both to Whisenhunt, which are hereby incorporated herein by reference.

Figure 2:
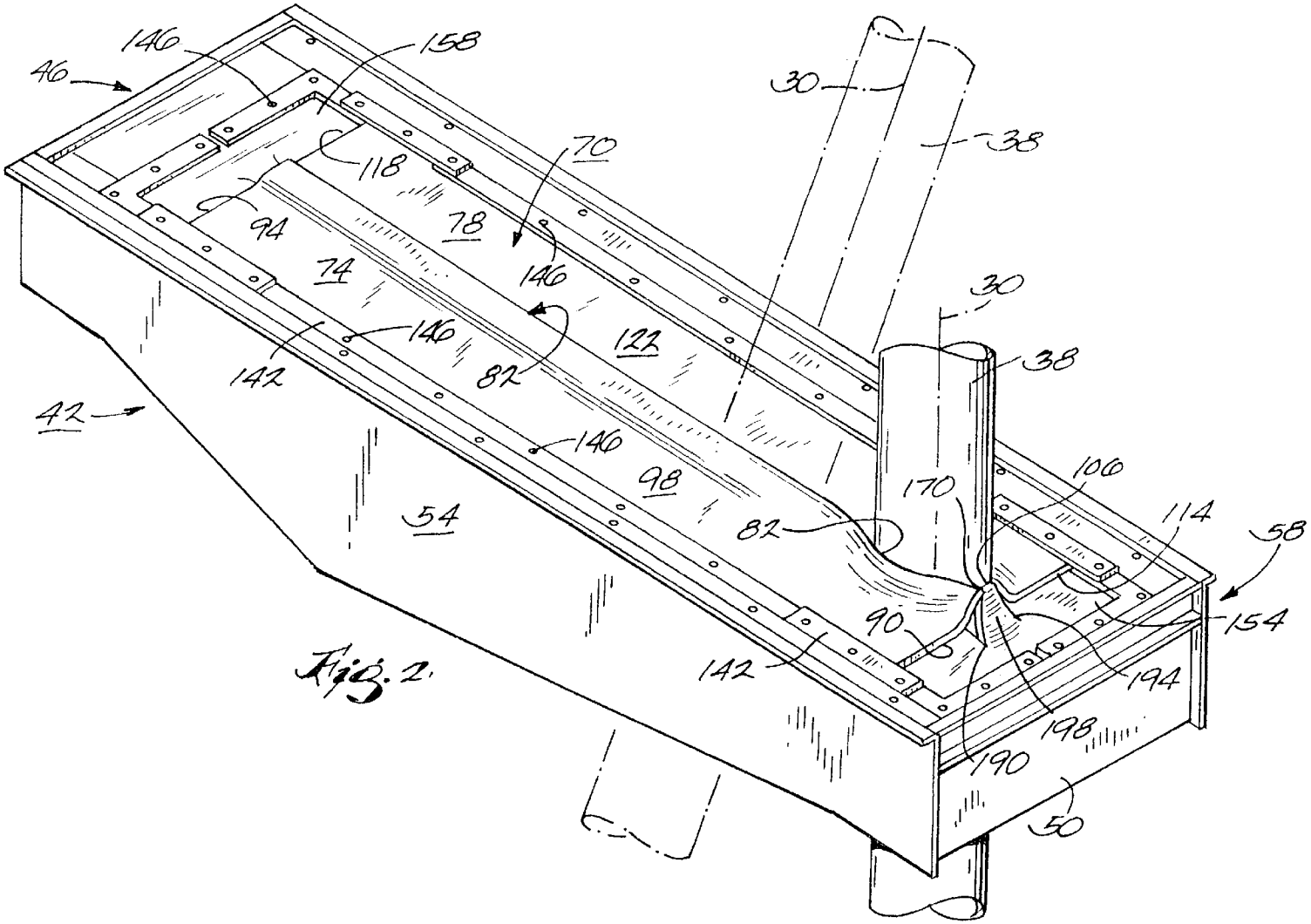
FIG. 2 is an enlarged partial perspective view of a drill deck of the blasthole drill illustrating an apparatus according to the present invention which seals the opening around a drill pipe, wherein the drill pipe is shown in a vertical (solid lines) position and a non-vertical (dashed lines) position.

Referring to FIG. 2, the blasthole drill 10 includes a drill deck 42. The drill deck 42 is supported by the frame 14 of the blasthole drill 10 illustrated in FIG. 1. The drill deck 42 is generally made of metal but can be made of other materials depending on the circumstances. The drill deck 42 includes a front wall 46, a back wall 50, and opposing side walls 54 and 58. The drill deck 42 is preferably rectangular in shape but may be of any number of different shapes. The drill deck 42 includes an opening 62 (see FIG. 4) which is generally defined by the walls 46, 50, 54 and 58. The drill deck 42 can be supported by the frame 14 in any number of conventional ways, but attaching the walls 46, 50, 54 and 58 of the drill deck 42 to the frame 14 with bolts 66 (see FIG. 4) or any other equivalent fastening means is generally acceptable.

As illustrated in FIG. 2, seal assembly 70 is connected to the drill deck 42 which effectively substantially closes the opening 62 of the drill deck 42. The drill pipe 38 extends through the opening 62 and is surrounded by the seal assembly 70. As previously explained, it is desirable to substantially seal the opening 62, especially around the drill pipe 38, so as to inhibit the escape of earth-cutting material and the like into the environment.

With continued reference to FIG. 2, the seal assembly 70 includes a first set of flexible seal flaps comprising a first flexible seal flap 74 and a second flexible seal flap 78. The flexible seal flaps 74 and 78 may be of any material suitable for use according to the principles of the present invention, but an industrial rubber-like material would be particularly well-suited for use. The seal flaps 74 and 78 are preferably rectangular in shape but may be of other shapes consistent with the principles of the present invention. As further explained below, the seal flaps 74 and 78 extend substantially the entire distance between the walls 46 and 50 adjacent the walls 54 and 58, respectively. The seal flap 74 includes a free edge 82 (see also FIG. 4), an opposite back edge 86 (see FIG. 4), opposite side edges 90 and 94, a top side 98 and a bottom side 102 (see FIG. 4). The seal flap 78 includes a free edge 106 (see also FIG. 4), an opposite back edge 110 (see FIG. 4), opposite side edges 114 and 118, a top side 122 and a bottom side 126 (see FIG. 4).

Figure 4:
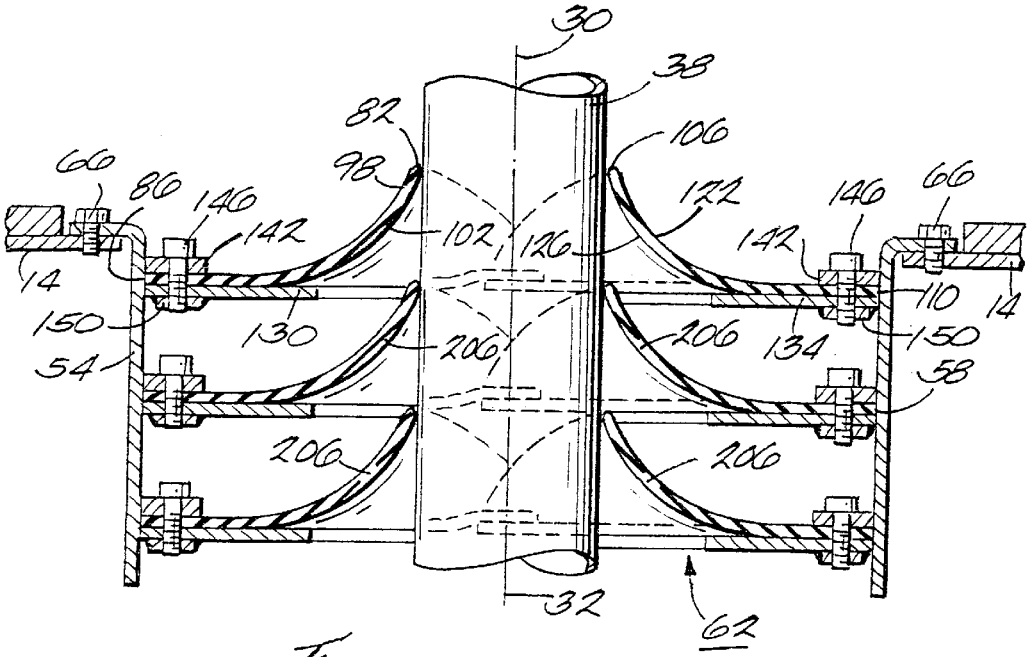
FIG. 4 is a cross-sectional view taken along line IV—IV of FIG. 5.

FIG. 4 best illustrates a preferred maimer of connecting the seal flaps 74 and 78 to the drill deck 42. As shown, drill deck 42 includes a first flange 130 extending from the side wall 54 into the opening 62, and a second flange 134 extending from the side wall 58 into the opening 62. The flanges 130 and 134 may be formed as a part of the walls 54 and 58, respectively, or the flanges 130 and 134 may be attached to the walls 54 and 58, respectively, in any number of ways known to those skilled in the art, such as by welding. Preferably, the flanges 130 and 134 are of at least the same length as the seal flaps 74 and 78 in order to properly support the respective seal flaps 74 and 78 as further explained below. The flanges 130 and 134 extend into the opening 62 in a way that will not prevent the drill pipe 38 from extending through the opening 62, nor will the flanges 130 and 134 prevent the desired movement of the drill pipe 38.

Referring still to FIG. 4, the seal flap 74 is positioned over flange 130 such that a portion of the bottom side 102 of seal flap 74 rests on top of the flange 130 for support. Edge 86 of the seal flap 74 preferably abuts against an inside surface of the side wall 54. A retaining strip 142 (see also FIG. 2), preferably made of metal, is placed over and into contact with a portion of the top side 98 of the seal flap 74 at or near the inside surface of the side wall 54. Multiple retaining strips 142 may be used as needed as is shown in FIG. 2. A plurality of bolts 146 (see also FIG. 2) extend through the retaining strip 142, the seal flap 74 and the flange 130. Nuts 150 are threaded onto the bolts 146 to secure the seal flap 74 to the drill deck 42.

The seal flap 78 is connected to the drill deck 42 in the same manner as the seal flap 74 is connected to the drill deck 42 such that further description is not necessary. It should be noted that the seal flaps 74 and 78 can be connected to the drill deck 42 in any number of different ways, such as with adhesive, and still provide the features according to the principles of the present invention.

With reference to FIGS. 2 and 4, the position of the first seal flap 74 with respect to the position of the second seal flap 78 in relation to the drill deck 42 and drill pipe 38 will now be described. As can be observed, a portion of the seal flap 74 overlaps and engages a portion of the seal flap 78. FIG. 4 best illustrates, in dashed lines, the overlapping portions of the seal flaps 74 and 78. The bottom side 102 of the seal flap 74 partially overlaps and engages the top side 122 of the seal flap 78. The free edge 82 of the seal flap 74 is located on one side of the plane 32 and the free edge 106 of the seal flap 78 is located on the opposite side of the plane 32. As also shown in FIG. 4, the flanges 130 and 134 do not extend as far inward with respect to walls 54 and 58 as do seal flaps 74 and 78. The flanges 130 and 134 are intended to provide support for the flexible seals 74 and 78 but are not intended to prevent the flaps 74 and 78 from flexing when contact is made with the drill pipe 38 as will be further explained below. Although the seal flaps 74 and 78 are shown as bending in an upwards direction with respect to the flanges 130 and 134, it is envisioned that the seal flaps 74 and 78 can bend in a downward direction and still function according to the principles of the present invention.

FIGS. 2 and 4 illustrate how the sealing assembly 70 substantially seals the opening 62 and, in particular, the portion of the opening 62 around the drill pipe 38. The overlapping and engaging action of the seal flaps 74 and 78 effectively closes a majority of the opening 62 except for where the drill pipe 38 extends therethrough. In this location, the seal flaps 74 and 78 separate when the drill pipe 38 is passed through the opening 62 such that the free edges 82 and 106 of the respective seal flaps 74 and 78 engage opposite sides of the drill pipe 38. As a result, the opening 62 around the drill pipe 38 is substantially sealed. As the drill pipe 38 moves, the seal flaps 74 and 78 separate as needed to engage the opposite sides of the drill pipe 38 and, because of their flexible nature, overlap and engage each other as shown to close that portion of the opening 62 where the drill pipe 38 was previously located (see, e.g., FIG. 2 as compared to FIG. 5).

Figure 5:
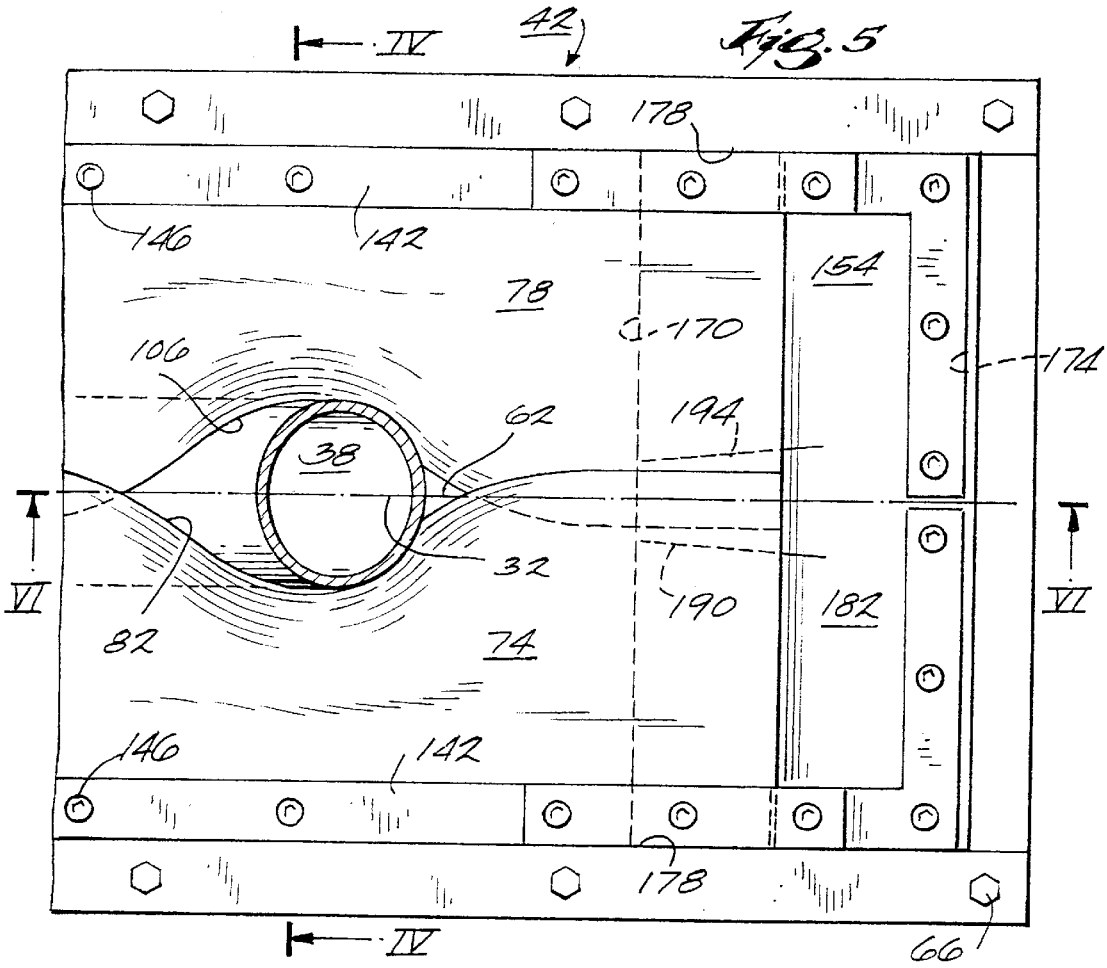
FIG. 5 is a partial top view of FIG. 2 wherein the drill pipe is shown in an angled or non-vertical position.
Figure 6:
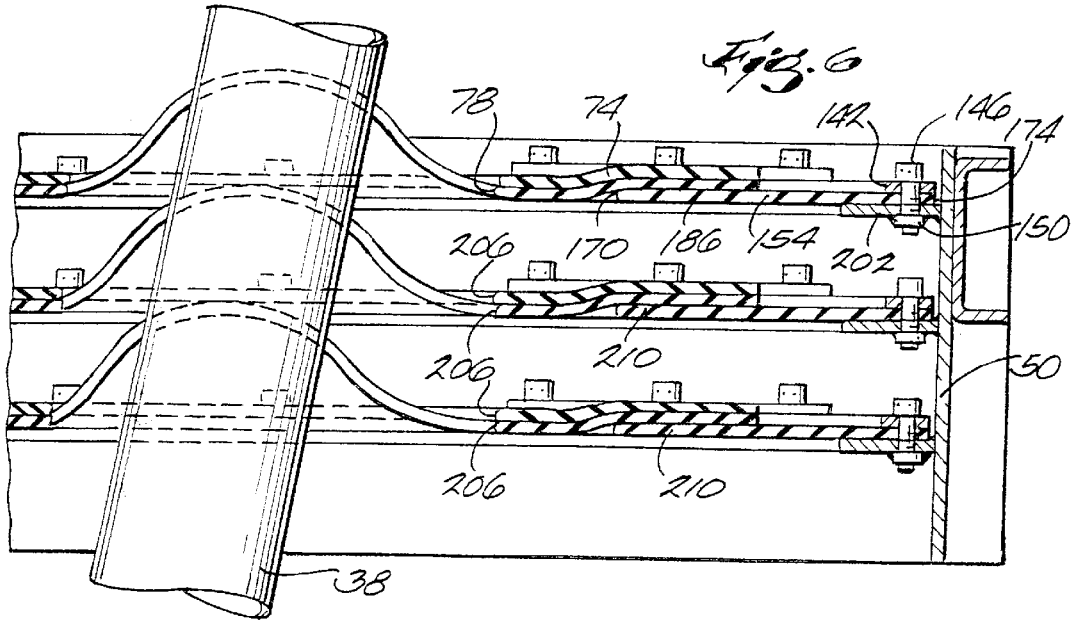
FIG. 6 is a cross-sectional view taken along line VI—VI of FIG. 5.

FIG. 5 shows the drill pipe 38 in a non-vertical position. As can be observed, the flexible nature of the seal flaps 74 and 78 enables the drill pipe 38 to be located in a non-vertical operating position while the seal flaps 74 and 78 still substantially seal the opening 62 around the drill pipe 38. Thus, the seal flaps 74 and 78 are capable of sealing the opening around the drill pipe 38 in each operating position of the drill pipe 38.

Figure 3:
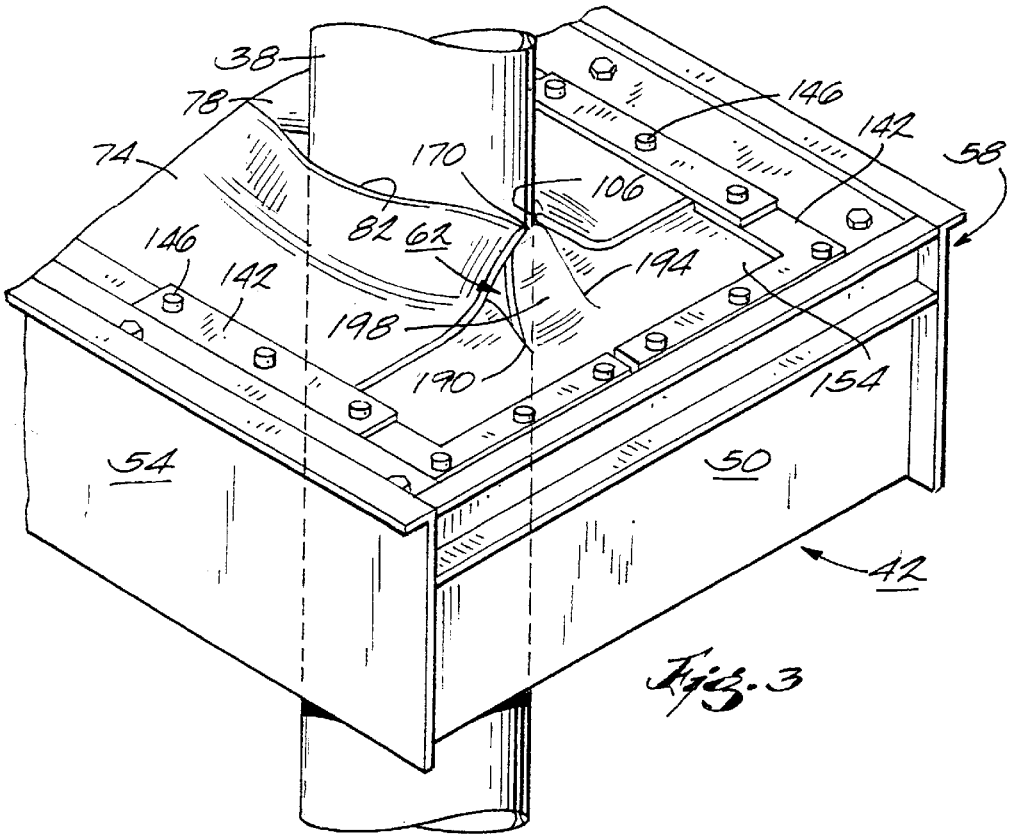
FIG. 3 is an enlarged portion of FIG. 2.

As shown in FIGS. 2–3 and 5–6, the seal assembly 70 includes flexible end seal flaps 154 and 158. Since the flaps 154 and 158 are virtually identical, reference to one can be viewed as reference to the other. The seal flaps 154 and 158 are preferably made of the same material as seal flaps 74 and 78. The seal flaps 154 and 158 are located at or near the walls 46 and 50, respectively. The seal flaps 154 and 158 each include a free edge 170, an opposite back edge 174, opposing side edges 178, a top side 182 and a bottom side 186. Each seal flap 154 and 158 includes spaced slits 190 and 194 which extend somewhat from the free edges 170 towards the opposite back edges 174 and which extend completely through each seal flap 154 and 158 from the top sides 182 through the bottom sides 186, thereby creating portions 198 of each seal flap 154 and 158 which are independently bendable with respect to the other portions of the respective seal flaps 154 and 158 upon contact with the drill pipe 38 so as to engage a portion of the drill pipe 38 to further seal the opening 62 around the drill pipe 38. The seal flaps 154 and 158 are preferably rectangular in shape and are connected to respective walls 46 and 50 of the drill deck 42 through use of flanges 202, retaining strips 142, bolts 146 and nuts 150 (see FIG. 6) in much the same way as seal flaps 74 and 78 are connected to the drill deck 42. With particular reference to FIGS. 2 and 3, it can be observed that the first and second seal flaps 74 and 78 partially overlap and engage the seal flaps 154 and 158. The respective bottom sides 102 and 126 of the seal flaps 74 and 78, mate against the respective top sides 182 of the seal flaps 154 and 158. As shown, when drill pipe 38 extends through the opening 62 in close proximity to the wall 50 of the drill deck 42 so as to contact a portion of the free edge 170 of the seal flap 154, the bendable portion 198 independently moves with respect to the other portions of the seal flap 154 so as to properly engage the drill pipe 38 to further seal the opening 62 around the drill pipe 38. Conversely, as shown in FIG. 5, if the drill pipe 38 is positioned so as not to come into contact with seal flap 154, the seal flaps 74 and 78 overlap the end seal flap 154 such that the bendable portion 198 is beneath the seal flaps 74 and 78.

The seal assembly 70 may also include second and third sets of flexible seal flaps 206, which are substantially identical to the seal flaps 74 and 78, beneath the seal flaps 74 and 78. Preferably, each set of seal flaps 206 cooperates with a pair of end seal flaps 210, which are substantially identical to seal flaps 154 and 158. The purpose of the additional flexible flaps is to increase the effectiveness of the sealing assembly 70, it being understood that more or fewer flaps can be used in accordance with the principles of the present invention.

Variations and modifications commensurate with the above teachings in skill or knowledge of the relevant art, are within the scope of the present invention. For example, the pliable membrane may be of any suitable material which allows a drill pipe to pass therethrough and which is also elastic enough to close back upon itself when the drilling angle of the drill pipe is adjusted and the position of the drill pipe relative to the drive deck changes. The embodiments described herein are intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A blasthole drill comprising:

a frame supported for movement over a ground surface, a mast supported by said frame for movement relative thereto between a vertical position and a plurality of non-vertical positions, said mast defining a drill hole axis which moves in a plane as said mast moves relative to said frame;

a drill pipe supported relative to said mast for movement along said drill hole axis;

a drill deck which is supported by said frame and which includes an opening through which said drill pipe extends such that said drill pipe moves relative to said drill deck when said mast moves relative to said frame; and first and second flexible seal flaps connected to said drill deck such that said first seal flap at least partially overlaps and engages said second seal flap, and such that said first and said second seal flaps are separable to engage opposite sides of the drill pipe to substantially seal said opening around the drill pipe in order to minimize passage of undesirable material through said opening.

2. A blasthole drill according to claim 1, wherein a plane extends through said opening, and wherein said plane splits the drill pipe substantially in half when the drill pipe extends through said opening, and wherein said first and second seal flaps each include an edge such that said edges are located on opposite sides of said plane, and such that when said first and second seal flaps separate, said edges engage opposite sides of the drill pipe.

3. A blasthole drill according to claim 1, wherein said drill deck includes first and second flanges extending into said opening such that said first seal flap is mounted to and at least partially supported by said first flange and said second seal flap is mounted to and at least partially supported by said second flange.

4. A blasthole drill according to claim 1, further comprising a first flexible end seal flap connected to said drill deck such that said first and second seal flaps at least partially overlap and engage said first end seal flap, wherein said first end seal flap includes slits therein so as to define a portion of said first end seal flap which is independently bendable with respect to other portions of said first end seal flap upon contact with the drill pipe so as to engage a further portion of the drill pipe to further seal said opening around the drill pipe.

5. A blasthole drill according to 4, further comprising a second flexible end seal flap connected to said drill deck opposite said first end seal flap such that said first and second seal flaps at least partially overlap and engage said second end seal flap, wherein said second end seal flap includes slits therein so as to define a portion of said second end seal flap which is independently bendable with respect to other portions of said second end seal flap upon contact with the drill pipe so as to engage a further portion of the drill pipe to further seal said opening around the drill pipe.

6. A blasthole drill according to claim 5, wherein said drill deck has opposite ends, and wherein said first and second seal flaps extend between said opposite ends, and wherein said first end seal flap is located at one of said ends of said drill deck and said second end seal flap is located at said other end of said drill deck.

7. A blasthole drill according to claim 6, wherein a plane extends through said opening, and wherein said plane splits the drill pipe substantially in half when the drill pipe extends through said opening, and wherein said first and second seal flaps each include an edge such that said edges are located on opposite sides of said plane, and such that when said first and second seal flaps separate, said edges engage opposite sides of the drill pipe, and wherein said drill deck includes first and second flanges extending into said opening such that said first seal flap is mounted to and at least partially supported by said first flange and said second seal flap is mounted to and at least partially supported by said second flange, and wherein said drill deck further includes first and second end flanges extending into said opening such that said first end seal flap is mounted to and at least partially supported by said first end flange and said second end seal flap is mounted to and partially supported by said second end flange.

8. A blasthole drill according to claim 7, wherein said drill deck is rectangular.

9. A blasthole drill according to claim 1, further comprising third and fourth flexible seal flaps connected to said drill deck below said first and second seal flaps such that said third seal flap at least partially overlaps and engages said fourth seal flap, and such that said third and fourth seal flaps arc separable to engage opposite sides of the drill pipe to further substantially seal said opening around the drill pipe.

10. A blasthole drill according to claim 9, further comprising fifth and sixth flexible seal flaps connected to said drill deck below said third and fourth seal flaps such that said fifth seal flap at least partially overlaps and engages said sixth seal flap, and such that said fifth and sixth seal flaps are separable to engage opposite sides of the drill pipe to further substantially seal said opening around the drill pipe.

11. A blasthole drill comprising:

a frame supported for movement over a ground surface;

a mast supported by said frame for movement relative thereto between a vertical position and a plurality of non-vertical positions, said mast defining a drill hole axis which moves in a plane as said mast moves relative to said frame;

a drill pipe supported relative to said mast for movement along said drill hole axis;

a drill deck which is supported by said frame and which includes an opening through which said drill pipe extends such that said drill pipe moves relative to said drill deck when said mast moves relative to said frame;

first and second flexible seal flaps connected to said drill deck and each including an edge, said first seal flap partially overlapping and engaging said second seal flap such that said edges of said first and second seal flaps are located on opposite sides of said plane, and such that said first and second seal flaps are separable so that said edges of said first and second seal flaps engage opposite sides of said drill pipe to substantially seal said opening around said drill pipe in each operable position of said drill pipe;

third and fourth flexible seal flaps connected to said drill deck below said first and second seal flaps and each including an edge, said third seal flap partially overlapping and engaging said fourth seal flap such that said edges of said third and fourth seal flaps are located on opposite sides of said plane, and such that said third and fourth seal flaps are separable so that said edges of said third and fourth seal flaps engage opposite sides of said drill pipe to further substantially seal said opening around said drill pipe in each operable position of said drill pipe; and fifth and sixth flexible seal flaps connected to said drill deck below said third and fourth seal flaps and each including an edge, said fifth seal flap partially overlapping and engaging said sixth seal flap such that said edges of said fifth and sixth seal flaps are located on opposite sides of said plane, and such that said fifth and sixth seal flaps are separable so that said edges of said fifth and sixth seal flaps engage opposite sides of said drill pipe to even further substantially seal said opening around said drill pipe in each operable position of said drill pipe, said seal flaps minimizing passage of undesirable material through said opening.

12. A blasthole drill according to claim 11, wherein said drill deck includes a plurality of flanges which extend into said opening such that each flap is individually mounted to and supported by a respective one of said plurality of flanges.

13. A blasthole drill according to claim 11, further comprising first, second and third flexible end seal flaps connected to said drill deck such that said first and second seal flaps at least partially overlap and engage said first end seal flap, and such that said third and fourth seal flaps at least partially overlap and engage said second end seal flap, and such that said fifth and sixth seal flaps at least partially overlap and engage said third end seal flap, wherein each of said end seal flaps includes slits therein so as to define a portion of each end seal flap which is independently bendable with respect to other portions of said respective end seal flap upon contact with said drill pipe so as to engage a further portion of said drill pipe to further seal said opening around said drill pipe.

14. A blasthole drill according to claim 13, further comprising fourth, fifth and sixth flexible end seal flaps connected to said drill deck opposite said first, second and third end seal flaps such that said first and second seal flaps at least partially overlap and engage said fourth end seal flap, and such that said third and fourth seal flaps at least partially overlap and engage said fifth end seal flap, and such that said fifth and sixth seal flaps at least partially overlap and engage said sixth end seal flap, wherein each of said fourth, fifth and sixth end seal flaps includes slits therein so as to define a portion of each end seal flap which is independently bendable with respect to other portions of said respective end seal flap upon contact with said drill pipe so as to engage a further portion of said drill pipe to further seal said opening around said drill pipe.

15. A blasthole drill according to claim 14, wherein said drill deck has opposite ends, and wherein said first, second, third, fourth, fifth and sixth seal flaps extend between said opposite ends of said drill deck, and wherein said first, second and third end seal flaps are located at one of said ends of said drill deck and said fourth, fifth and sixth end seal flaps are located at said other end of said drill deck.

16. A blasthole drill according to claim 15, wherein said drill deck includes a plurality of flanges which extend into said opening such that each flap is individually mounted to and supported by a respective one of said plurality of flanges.

17. A blasthole drill according to claim 16, wherein said drill deck is rectangular.

* * * * *